US005488825A

United States Patent [19]

Davis et al.

[11] Patent Number: 5,488,825

[45] Date of Patent: Feb. 6, 1996

[54] GAS TURBINE VANE WITH ENHANCED COOLING

[75] Inventors: Paul H. Davis, Orlando; Mark T. Kennedy, Oviedo; William E. North, Winter Springs, all of Fla.

[73] Assignee: Westinghouse Electric Corporation, Pittsburgh, Pa.

[21] Appl. No.: 332,309

[22] Filed: Oct. 31, 1994

[51] Int. Cl.[6] ..... F01D 5/18

[52] U.S. Cl. ..... 60/39.75; 415/115; 416/97 R

[58] Field of Search ..... 60/39.75; 415/115; 416/97 R

[56] References Cited

U.S. PATENT DOCUMENTS

| | | | |
|---|---|---|---|
| 3,171,631 | 3/1965 | Aspinwall | 416/97 R |
| 3,628,885 | 12/1971 | Sidenstick | 416/97 R |
| 3,834,831 | 9/1974 | Mitchell | 416/95 |
| 4,073,599 | 2/1978 | Allen et al. | 416/97 R |
| 4,292,008 | 9/1981 | Grosjean | 415/115 |
| 4,416,585 | 11/1983 | Abdel-Messeh | 415/115 |
| 4,456,428 | 6/1984 | Cuvillier | 416/97 R |
| 4,474,532 | 10/1984 | Pazder | 416/97 R |
| 4,514,144 | 4/1985 | Lee | 416/97 R |
| 4,604,031 | 8/1986 | Moss et al. | 415/115 |
| 4,775,296 | 10/1988 | Schwarzmann et al. | 415/115 |
| 4,786,233 | 11/1988 | Shizuya et al. | 416/97 R |
| 4,930,980 | 6/1990 | North et al. | 415/115 |
| 4,940,388 | 7/1990 | Lilleker et al. | 416/97 R |
| 4,962,640 | 10/1990 | Tobery | 60/39.02 |
| 4,992,026 | 2/1991 | Ohtomo et al. | 416/97 R |
| 5,052,889 | 10/1991 | Abdel-Messeh | 416/97 R |
| 5,117,626 | 6/1992 | North et al. | 60/39.75 |
| 5,145,315 | 9/1992 | North et al. | 415/115 |
| 5,203,873 | 4/1993 | Corsmeier et al. | 416/97 R |
| 5,246,341 | 9/1993 | Hall et al. | 416/97 R |
| 5,320,483 | 6/1994 | Cunha et al. | 415/115 |
| 5,387,085 | 2/1995 | Thomas, Jr. et al. | 416/97 R |
| 5,387,086 | 2/1995 | Frey et al. | 416/97 R |
| 5,395,212 | 3/1995 | Anzai et al. | 416/97 R |

OTHER PUBLICATIONS

Lau et al., "Heat Transfer Characteristics of Turbulent Flow in a Square Channel with Angled Discrete Ribs", ASME 90–GT–254, Gas Turbine and Aeroengine Congress and Exposition, American Society of Mechanical Engineers, Jun. 1990.

Han et al., "Effect of Rib–Angle Orientation on Local Mass Transfer Distribution in a Three–Pass Rib–Roughened Channel", 89–GT–98, Gas Turbine and Aeroengine Congress and Exposition, American Society of Mechanical Engineers, Jun. 1989.

*Primary Examiner*—Richard A. Bertsch
*Assistant Examiner*—Ted Kim
*Attorney, Agent, or Firm*—M. G. Panian

[57] ABSTRACT

A gas turbine stationary vane having an airfoil portion and inner and outer shrouds. Five serpentine radially extending cooling air passages are formed in the vane airfoil. The first passage is disposed adjacent the leading edge of the airfoil and the second passage is disposed adjacent the trailing edge. A first portion of the cooling air enters the first passage, from which it flows sequentially to the second, third, fourth and fifth passages. Additional cooling air enters the third passage directly, thereby bypassing the first and second passages and preventing over heating of the cooling air by the time it reaches the fifth passage. A radial tube extends through the second passage and directs cooling air through the airfoil, with essentially no rise in temperature, to an interstage cavity for disc cooling. Fins project into each of the passages and serve to increase the effectiveness and flow rate of the cooling air. The fins in the first and fifth passages are angled so as to direct the cooling air toward the leading and trailing edges, respectively. In addition, the fins in the second through fifth passages are angled to retard flow separation as the cooling air turns 180° from one passage to the next.

19 Claims, 5 Drawing Sheets

GAS TURBINE VANE WITH ENHANCED COOLING

BACKGROUND OF THE INVENTION

The present invention relates to a stationary vane in a gas turbine. More specifically, the present invention relates to a gas turbine stationary vane having a serpentine cooling air flow path with enhanced cooling effectiveness.

A gas turbine employs a plurality of stationary vanes that are circumferentially arranged in rows in a turbine section. Since such vanes are exposed to the hot gas discharging from the combustion section, cooling of these vanes is of the utmost importance. Typically, cooling is accomplished by flowing cooling air through cavities formed inside the vane airfoil.

According to one approach, cooling of the vane airfoil is accomplished by incorporating one or more tubular inserts into each of the airfoil cavities so that passages surrounding the inserts are formed between the inserts and the walls of the airfoil. The inserts have a number of holes distributed around their periphery that distribute the cooling air around these passages.

According to another approach, each airfoil cavity includes a number of radially extending passages, typically three, forming a serpentine array. Cooling air, supplied to the vane outer shroud, enters the first passage and flows radially inward until it reaches the vane inner shroud. A first portion of the cooling air exits the vane through the inner shroud and enters a cavity located between adjacent rows of rotor discs. The cooling air in the cavity serves to cool the faces of the discs. A second portion of the cooling air reverses direction and flows radially outward through the second passage until it reaches the outer shroud, whereupon it changes direction again and flows radially inward through the third passage, eventually exiting the blade from the third passage through holes in the trailing edge of the airfoil.

Various methods have been tried to increase the effectiveness of the cooling air flowing through the serpentine passages. One such approach involves the use of fins extending from the walls that form the passages. The use of both fins that extend perpendicular to the direction of flow and fins that are angled to the direction of flow have been tried. However, the ability of such schemes to adequately cool the vane airfoils is impaired in gas turbines in which the airfoils have large a cross-sectional area since this reduces the velocity, and hence the heat transfer coefficient, of the cooling air flowing through the passages. The cooling ability of such schemes is also impaired when used in conjunction with higher pressure ratio compressors, since the cooling air bled from such compressors is at a relatively high temperature.

Moreover, as the cooling air absorbs heat from the vane airfoil it becomes hotter. Consequently, the cooling air may become too hot to cool the trailing edge of the airfoil by the time it reaches the last serpentine passage, especially if more than three such passages are utilized. Also, excessive heat up of the cooling air as a result of airfoil cooling may render the cooling air too hot to cool the cavity between the discs.

One potential solution to these problems is to dramatically increase the cooling air supplied to the airfoil, thereby increasing the flow rate of the cooling air flowing through the passages. However, such a large increase in cooling air flow is undesirable. Although such cooling air eventually enters the hot gas flowing through the turbine section, little useful work is obtained from the cooling air, since it was not subject to heat up in the combustion section. Thus, to achieve high efficiency, it is crucial that the use of cooling air be kept to a minimum.

It is therefore desirable to provide a cooling scheme that significantly increases the cooling effectiveness of the cooling air flowing through the airfoil of a stationary vane in a gas turbine. It is also desirable to prevent excessive heat-up of the portion of the cooling air used to cool the trailing edge portion of the vane airfoil, as well as the portion of the cooling air used to cool the rotor discs.

SUMMARY OF THE INVENTION

Accordingly, it is the general object of the current invention to provide a cooling scheme that significantly increases the cooling effectiveness of the cooling air flowing through the airfoil of a stationary vane in a gas turbine and that prevents excessive heat-up of the portions of the cooling air used to cool the trailing edge portion of the vane airfoil and the rotor discs.

Briefly, this object, as well as other objects of the current invention, is accomplished in a turbomachine comprising a compressor for producing compressed air, a combustor for heating a first portion of the compressed air, thereby producing a hot compressed gas, and a turbine for expanding the hot compressed gas. The turbine has a stationary vane disposed therein for directing the flow of the hot compressed gas. The vane has at least first and second cooling air passages formed therein, the first passage having means for receiving a second portion of the compressed air. The first and second passages are in sequential flow communication, whereby the second portion of the compressed air flows sequentially through the first passage and then through the second passage. The second passage has means for receiving a third portion of the compressed air that bypasses the first passage, whereby the second and third portions of the compressed air combine in and flow through the second passage.

According to one aspect of the invention, the vane further comprises inner and outer shrouds and a conduit extending through the inner and outer shrouds and one of the cooling air passages. In addition, a cavity is formed between the vane inner shroud and a rotor. The conduit has an outlet in flow communication with the cavity, whereby the conduit directs a fourth portion of the compressed air through the inner and outer shrouds and the one of the passages to the cavity.

According to another aspect of the current invention, the vane further comprises (i) a third cooling air passage, the first passage being in sequential flow communication with the third passage, whereby the second portion of the compressed air flows sequentially from the third passage to the first passage, (ii) first and second walls enclosing the second and third passages, (iii) a plurality of first fins extending from one of the walls into the third passage, and (iv) a plurality of second fins extending from one of the walls into the second passage. Each of the second and third passages extends radially through the vane and the first and second fins are angled with respect to the radial direction.

DESCRIPTION OF THE PREFERRED EMBODIMENT

Figure 1:
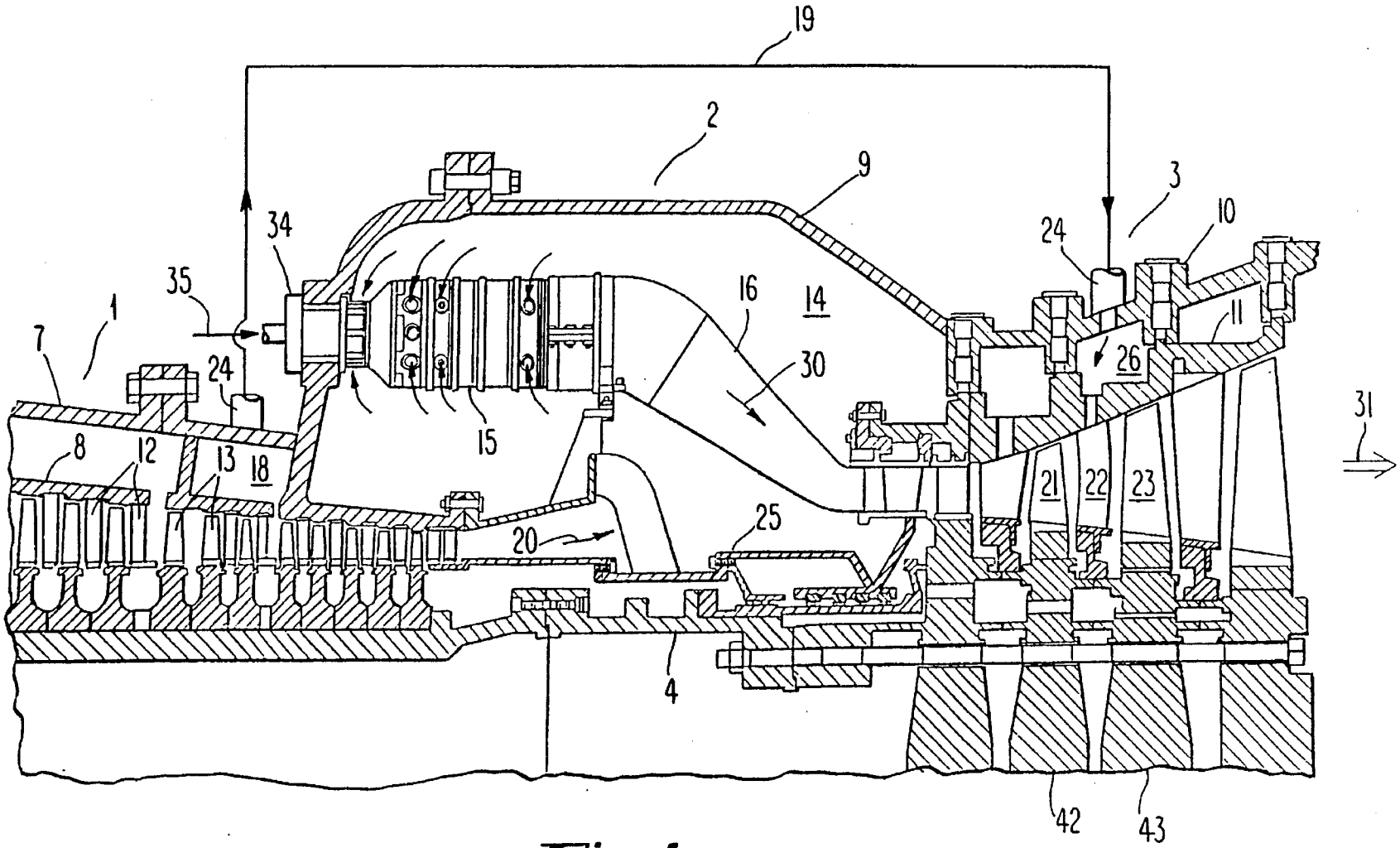
FIG. 1 is a longitudinal cross-section, partially schematic, of a gas turbine incorporating the row 3 turbine vane of the current invention.

Referring to the drawings, there is shown in FIG. 1 a longitudinal cross-section through a portion of a gas turbine. The major Components of the gas turbine are a compressor section 1, a combustion section 2, and a turbine section 3. As can be seen, a rotor 4 is centrally disposed and extends through the three sections. The compressor section 1 is comprised of cylinders 7 and 8 that enclose alternating rows of stationary vanes 12 and rotating blades 13. The stationary vanes 12 are affixed to the cylinder 8 and the rotating blades 13 are affixed to discs attached to the rotor 4.

The combustion section 2 is comprised of an approximately cylindrical shell 9 that forms a chamber 14, together with the aft end of the cylinder 8 and a housing 25 that encircles a portion of the rotor 4. A plurality of combustors 15 and ducts 16 are contained within the chamber 14. The ducts 16 connect the combustors 15 to the turbine section 3. Fuel 35, which may be in liquid or gaseous form—such as distillate oil or natural gas—enters each combustor 15 through a fuel nozzle 34 and is burned therein so as to form a hot compressed gas 30.

The turbine section 3 is comprised of an outer cylinder 10 that encloses an inner cylinder 11. The inner cylinder 11 encloses rows of stationary vanes and rows of rotating blades that are circumferentially arranged around the centerline of the rotor 4. The stationary vanes are affixed to the inner cylinder 11 and the rotating blades are affixed to discs that form a portion of the turbine section of the rotor 4.

In operation, the compressor section 1 inducts ambient air and compresses it. A portion of the air that enters the compressor is bled off after it has been partially compressed and is used to cool the rows 2–4 stationary vanes within the turbine section 3, as discussed more fully below with respect to the row three vanes 22. The remainder of the compressed air 20 is discharged from the compressor section 1 and enters the chamber 14. A portion of the compressed air 20 is drawn from the chamber 14 and used to cool the first row of stationary vanes, as well as the rotor 4 and the rotating blades attached to the rotor. The remainder of the compressed air 20 in the chamber 14 is distributed to each of the combustors 15.

In the combustors 15, the fuel 35 is mixed with the compressed air and burned, thereby forming the hot compressed gas 30. The hot compressed gas 30 flows through the ducts 16 and then through the rows of stationary vanes and rotating blades in the turbine section 3, wherein the gas expands and generates power that drives the rotor 4. The expanded gas 31 is then exhausted from the turbine 3.

The current invention is directed to the cooling of the stationary vanes and will be discussed in detail with reference to the third row of stationary vanes 22. As shown in FIG. 1, a portion 19 of the air flowing through the compressor 1 is extracted from an interstage bleed manifold 18, via a pipe 24, and is directed to the turbine section 3. In the turbine section 3, the cooling air 19 enters a manifold 26 formed between the inner cylinder 11 and the outer cylinder 10. From the manifold 26, the cooling air 19 enters the third row vanes 22.

As shown in FIGS. 2–5, the vane 22 is comprised of an airfoil portion 37 that is disposed between inner and outer shrouds 36 and 38, respectively. Support rails 56 and 57 are used to attach the vane 22 to the turbine inner cylinder 11. As shown best in FIG. 5, the airfoil portion 37 of the vane 22 is formed by a generally concave shaped wall 46, which forms the pressure surface of the airfoil, and a generally convex wall 47, which forms the suction surface of the airfoil. At their upstream and downstream ends, the walls 46 and 47 form the leading and trailing edges 40 and 41, respectively, of the airfoil 37.

The airfoil 37 is substantially hollow. As shown best in FIGS. 3 and 5, radially extending walls 65–68 extend between the walls 46 and 47 and separate the interior of the airfoil 37 into five radially extending cooling air passages 51–55. A first opening 58 in the outer shroud 38 allows a portion 80 of the cooling air 19 from the manifold 26 to enter the first passage 51, which is disposed adjacent the leading edge 40. Importantly, the walls 65–68 do not extend all the way from the inner shroud 36 to the outer shroud 38. Instead they stop short of either the inner or outer shroud, depending on the particular wall, so as to form a connecting passage that allows each of the passages 51–55 to communicate with the adjacent passage. Consequently, the passages 51–55 are arranged in a serpentine fashion so that the cooling air 80 flows sequentially from passage 51 to passage 52 to passage 53 to passage 54 and finally to passage 55, which is adjacent the trailing edge 41. Between each of the passages 51–55, inner and outer shrouds 36 and 38, respectively, cause the cooling air to turn approximately 180° before it enters the adjacent passage.

Figure 3:
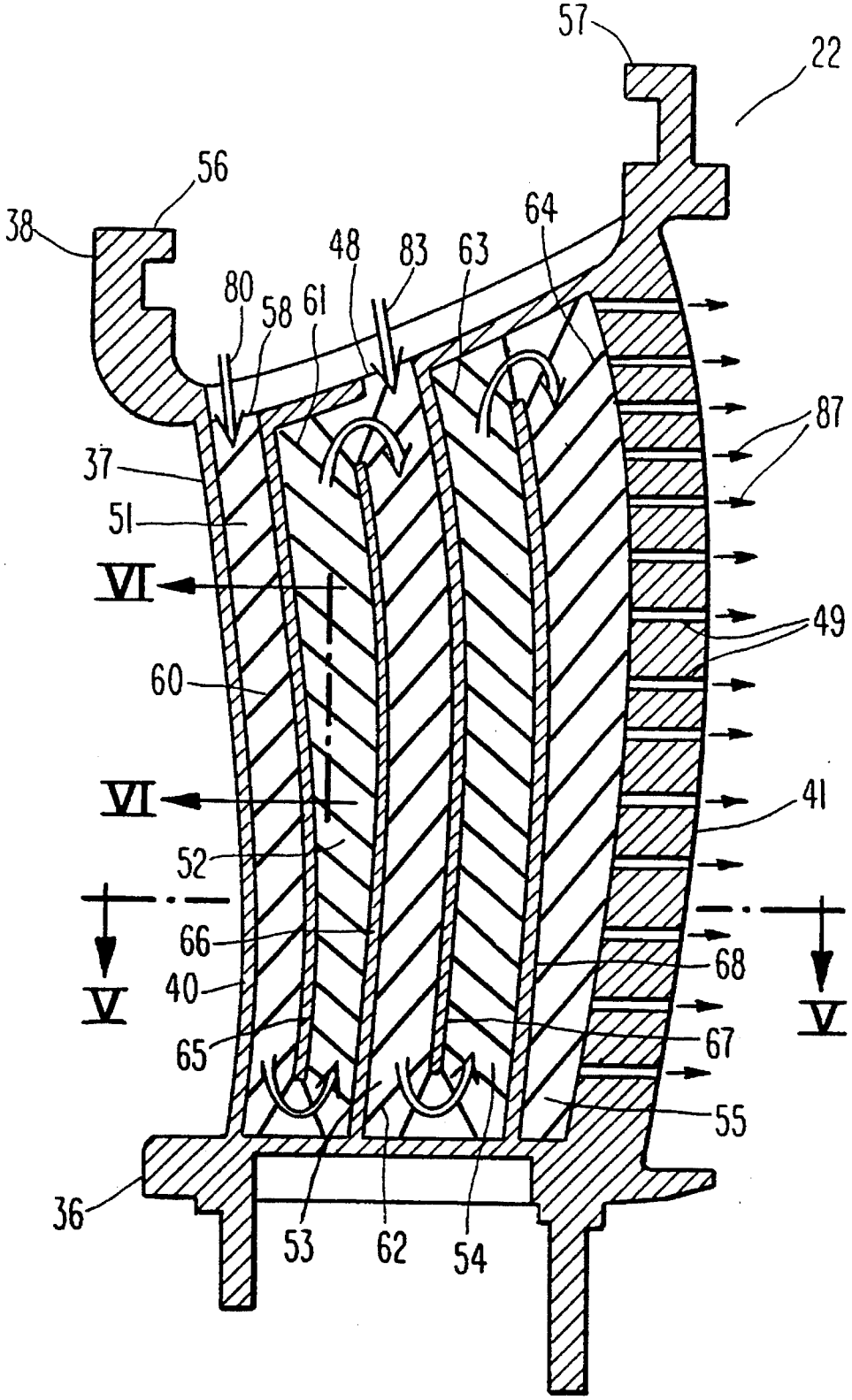
FIG. 3 is a cross-section through the row 3 vane shown in FIG. 2 showing the arrangement of the cooling air fins, and with the disc cavity cooling air supply tube omitted for clarity.
Figure 4:
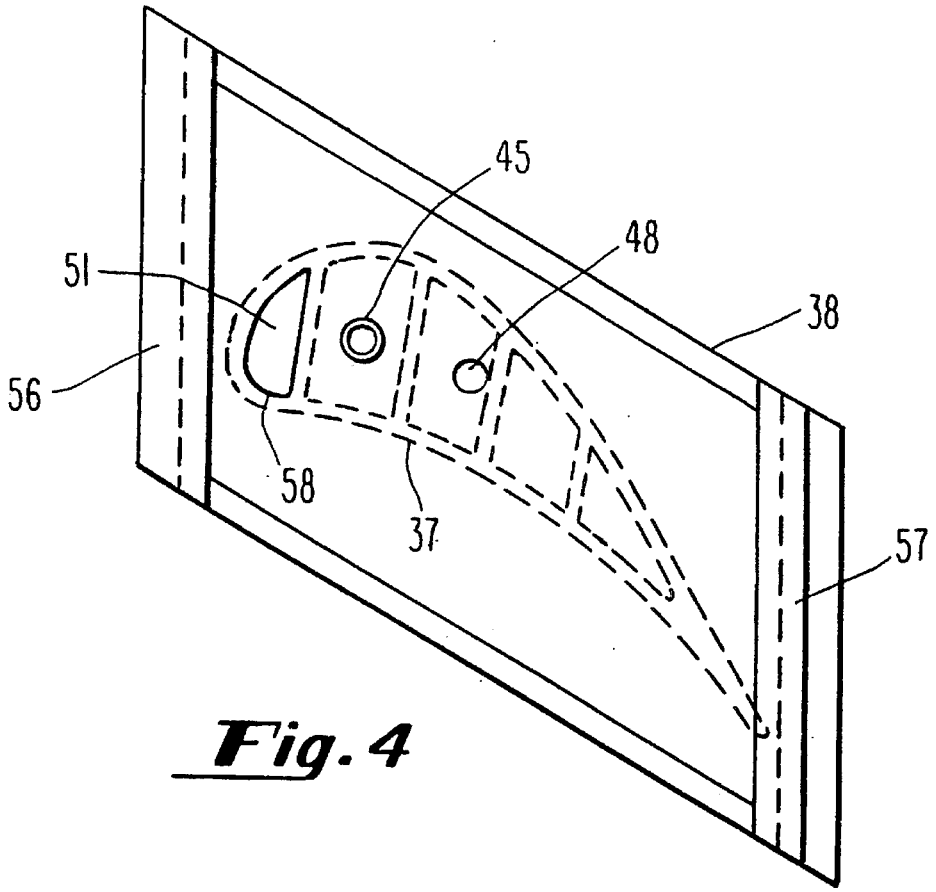
FIG. 4 is a view taken along line IV—IV shown in FIG. 2.
Figure 5:
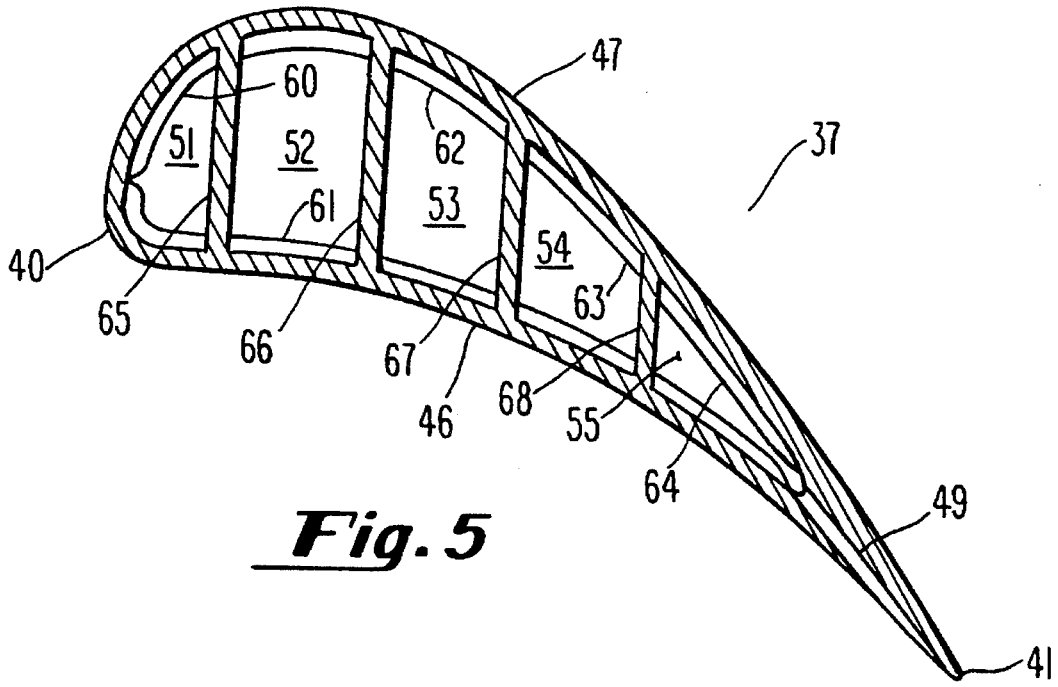
FIG. 5 is a transverse cross-section taken along line V—V shown in FIG. 3.

From passage 55, the cooling air is divided into a plurality of small streams 87 that exit the vane 22 through a plurality of axially extending passages 49 formed in the trailing edge 41 of the airfoil 37, as shown best in FIG. 3. Upon exiting the vane 22, the streams of cooling air 87 mix with the hot gas 30 flowing through the turbine section 3.

According to an important aspect of the current invention, a second opening 48 is formed in the outer shroud 38. The second opening 48 allows a second portion 83 of the cooling air 19 from the manifold 26 to bypass the first and second passages 51 and 52, respectively; and enter the third passage 53 directly. In the third passage 53, the portions 80 and 83 of cooling air combine, thereby increasing the flow of cooling air through the third, fourth and fifth passages 53–55, respectively. More importantly, the bypass cooling air 83 cools the cooling air 80, which has experienced considerable heating as a result of having flowed through the first and second passages 51 and 52, respectively. Thus, although in the preferred embodiment of the invention there are a total five serpentine passages 51–55, excessive heat up of the cooling air by the time it reaches the fifth passage 55 is prevented, thereby ensuring that the temperature of the cooling air in passage 55 is sufficiently low to adequately cool the trailing edge portion 41 of the airfoil 37.

Figure 2:
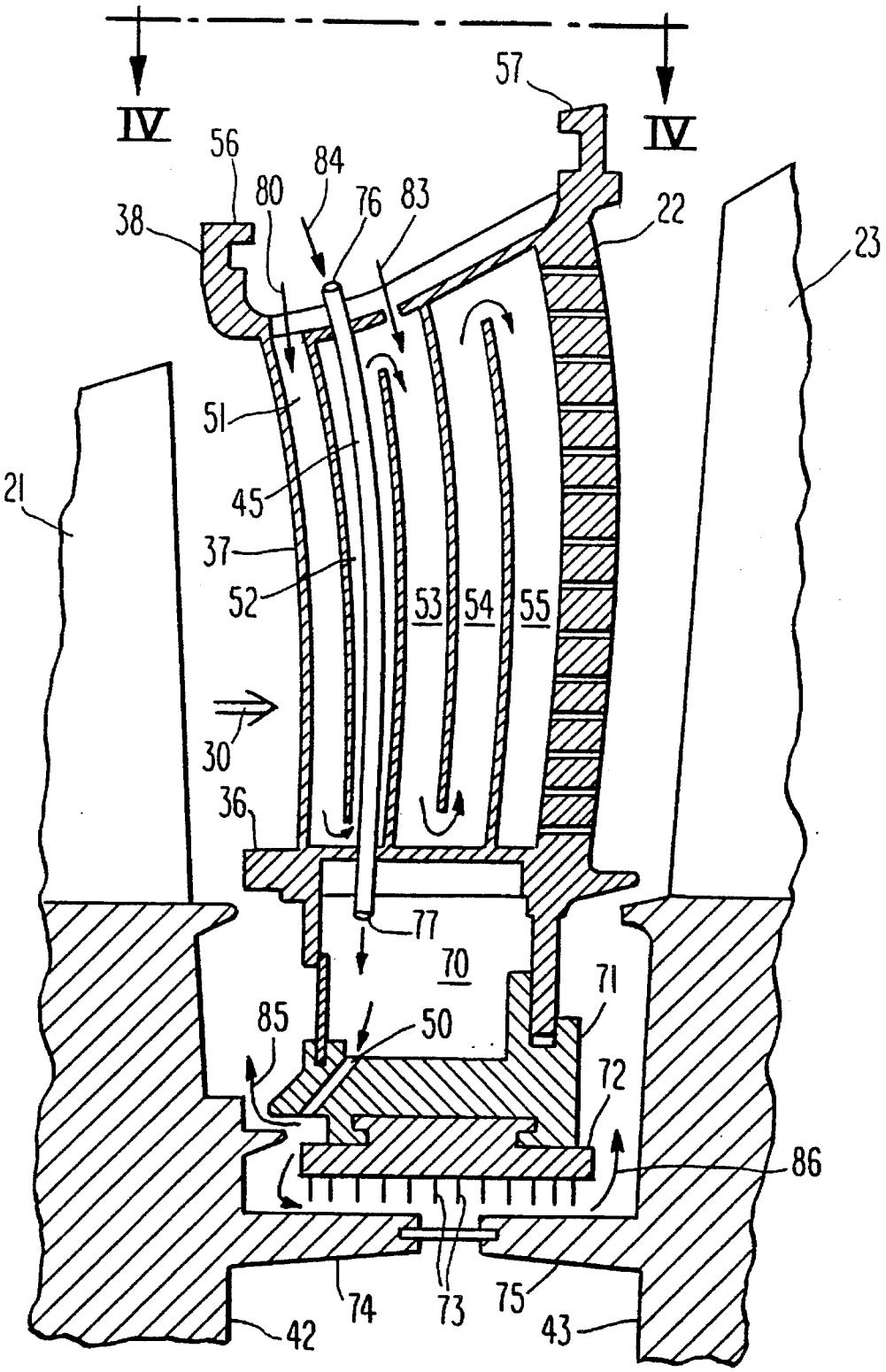
FIG. 2 is a detailed view of the portion of FIG. 1 in the vicinity of the row 3 vane, with the cooling air fins deleted for clarity.

As shown best in FIG. 2, a hollow, radially extending disc cavity cooling air supply tube 45 extends through the inner and outer shrouds 36 and 38, respectively, and through the second passage 52. An inlet 76 formed in one end of the tube 45 receives a third portion 84 of the cooling air 19 from the manifold 26. An outlet 77 formed in the other end of the tube discharges the cooling air 84 to a cavity 70 formed between the inner shroud 36 and the discs 42 and 43 of the rotor 4. The second row of rotating blades 21 are attached to the disc 42 and the third row of rotating blades 23 are attached to the disc 43.

An interstage seal housing 71 is attached to the inner shroud 36 by bolts (not shown) and carries a seal 72. A plurality of labyrinth fins 73 extend into an annular passage formed between the seal 72 and arms 74 and 75 that extend from the discs 42 and 43, respectively. The seal housing 71 controls the flow of cooling air 84 from the cavity 70. Specifically, passages 50 in the housing 71 direct the cooling air out of the cavity 70, whereupon it is split into two streams 85 and 86. The first stream 85 flows radially outward into the hot gas 30 flowing through the turbine section 3. In so doing, the cooling air 85 cools the rear face of the disc 42 and prevents the hot gas 30 from flowing over the disc face.

The second stream 86 flows through the annular labyrinth seal passage and then flows radially outward into the hot gas 30 flowing through the turbine section 3. In so doing, the cooling air 86 cools the front face of the disc 43 and prevents the hot gas 30 from flowing over the disc face.

Since the pressure of the hot gas 30 flowing over the third row of rotating blades 23 is lower than that flowing over the second row of rotating blades 21, were it not for the seal 72 substantially all of the cooling air would flow downstream to the disc 43.. The seal 72 prevents this from happening, thereby ensuring cooling of the upstream disc 42.

The disc cavity cooling air supply tube 45 allows the cooling air 84 to flow through the vane 22 with minimal heat absorption. Thus, according to an important aspect of the current invention, the tube 45 allows cooling air 84 from the manifold 26 to be directed to the interstage cavity 70 with essentially no rise in the temperature of the cooling air, thereby ensuring its ability to cool the discs 42 and 43. As previously discussed, this is especially important in turbines in which the temperature of the cooling air 19 supplied to the manifold 26 is already fairly high.

Figure 6:
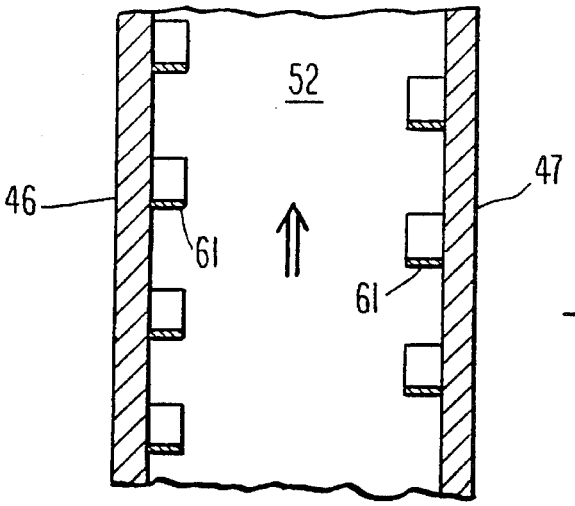
FIG. 6 is a cross-section taken along line VI—VI shown in FIG. 3, showing the second cooling air passage.

According to the current invention, a plurality of fins 60–64—sometimes referred to as turbulating ribs—project from the walls 46 and 47 into the passages 51–55, as shown in FIGS. 3, 5, 6 and 7. As shown in FIG. 3, the fins 60–64 are preferably distributed along substantially the entire height of the passages 51–55. Moreover, as shown in FIG. 3, the fins 60–64 preferably extend along substantially the entire axial length of the passages 51–55. FIG. 6 shows the fins 61 in the second passage 52 but is typical of the arrangement of the fins in each of the passages. As shown in FIG. 6, the fins 61 project transversely into the second passage 52 from opposing walls 46 and 47 of the airfoil 37 and, preferably, have a height equal to approximately 10% of the width of the passage. The fins 61 are staggered so that the fins projecting from the wall 46 are disposed between the fins projecting from the wall 47. The fins 60–64 serve to increase the turbulence in the cooling air 80 and 83 flowing through the passages 51–55, thereby increasing its effectiveness.

Figure 7:
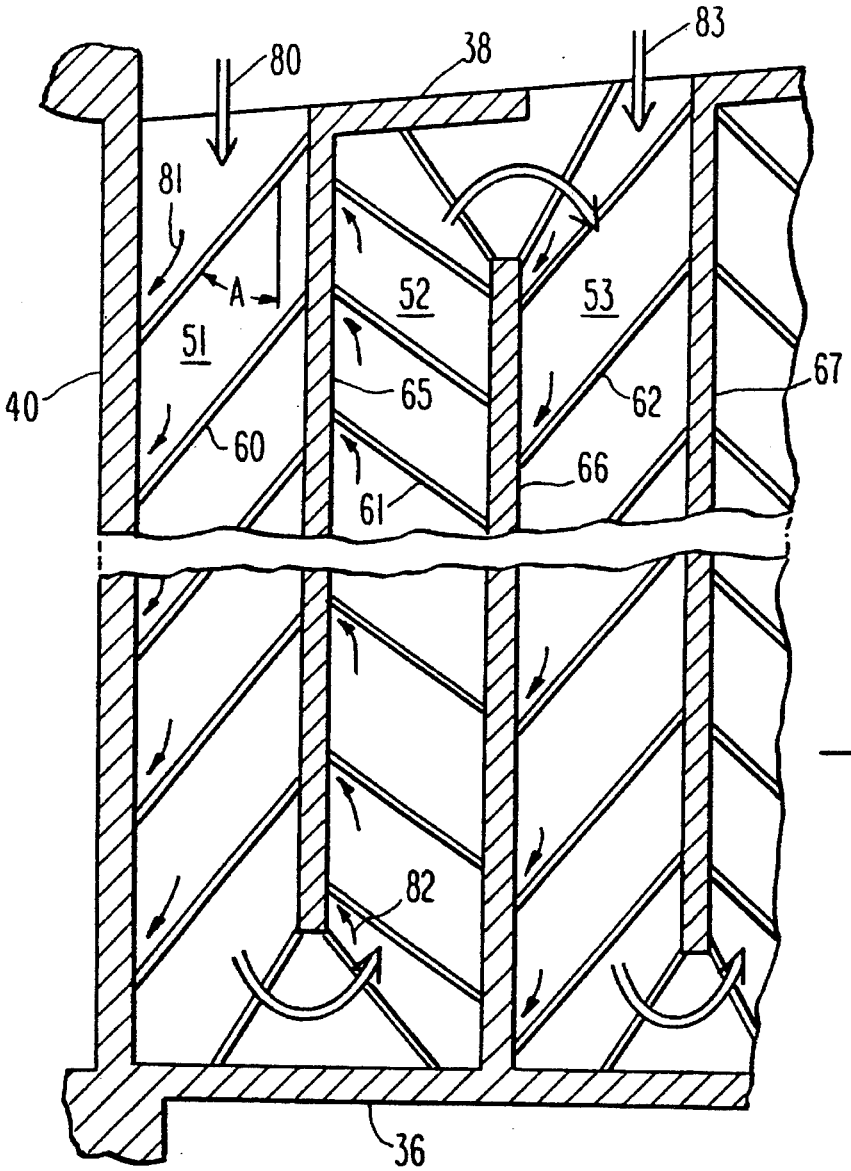
FIG. 7 is a detained view of portions of the first three cooling air passages shown in FIG. 3.

According to another important aspect of the current invention, the fins 60–64 are angled with respect to the direction of flow of the cooling air through the passages 51–55—which is essentially in the radial direction. Thus, as shown in FIG. 7, the fins form an acute angle A with respect to the radial direction. In the preferred embodiment, the angle A with respect to the radially inward direction is in the range of approximately 45°–60°, most preferably 45°. This is so whether the fins are angled radially inwardly as they extend upstream to the direction of the flow of hot compressed gas 30, as in the first, third and fifth passages, or whether they are angled radially outwardly as they extend upstream, as in the second and fourth passages.

In the first passage 51, the cooling air 80 flows radially inward from the outer shroud 38 to the inner shroud 36. According to another important aspect of the current invention, the fins 60 in the first passage 51 are angled so that they extend radially inward—that is, toward the inner shroud 36—as they extend in the upstream direction toward the leading edge 40, as shown in FIGS. 3 and 7. As a result, the cooling air 80 is guided so that it flows toward the leading edge 40 as it flows radially inward, as shown best by the arrows indicated by reference numeral 81 in FIG. 7. Thus, the fins 60 not only increase the turbulence of the cooling air 80 but also serve to direct it against the leading edge 40, thereby increasing the effectiveness of the cooling of the leading edge. This is important since the hot gas 30 flowing through the turbine section 3 impinges directly on the leading edge 40 so that it is one of the portions of the airfoil 37 most susceptible to over heating.

In the fifth passage 55, the cooling air 80 and 83 flows radially outward from the inner shroud 36 to the outer shroud 38. Thus, employing a similar arrangement as that used in the first passage 51, the fins 64 in the fifth passage 55 are angled so that they extend radially outward—that is, toward the outer shroud 38—as they extend in the downstream direction toward the trailing edge 41, as shown in FIG. 3. As a result, the cooling air 80 and 83 is guided so that it flows toward the trailing edge 40 as it flows radially outward, thereby direct the cooling air against the trailing edge 41 so as to increase the effectiveness of the cooling of the trailing edge. This too is important since, as a result of its relatively thin cross-section, the trailing edge 41 is another one of the portions of the airfoil 37 that are susceptible to over heating.

In flowing from the first passage 51 to the second passage 52, the inner shroud 36 causes the cooling air 80 to turn 180°, as previously discussed. Such an abrupt change in direction has a tendency to cause flow separation of the cooling air as it flows around the turn. Such flow separation is undesirable since it reduces the flow rate of cooling air through the passages. Therefore, according to still another important aspect of the current invention, the tendency of the cooling air to experience flow separation is retarded by angling the fins 61 in the second passage 52 so that they extend radially outward—that is, toward the outer shroud 38—as they extend in the upstream direction toward the wall 65 dividing the first and second passages. This causes the cooling air 80 to be guided so that it flows toward the dividing wall 65 as it completes its travel around the turn, as shown best by the arrows indicated by reference numeral 82 in FIG. 7. Such guiding of the cooling air 80 toward, rather than away from, the dividing wall 65—and, hence, toward the direction of rotation of the cooling air as it makes the turn—inhibits the tendency for flow separation.

According to the current invention, this scheme for orienting the fins is implemented in the third, fourth and fifth passages 53–55, respectively, as well. Consequently, as shown in FIG. 7, the fins 62 in the third passage 53 are angled so that they extend radially inward—that is, toward the inner shroud 36—as they extend in the upstream direction toward the wall 66 dividing the second and third passages. Similarly, as shown in FIG. 3, the fins 63 in the fourth passage 54 are angled so that they extend radially outward—that is, toward the outer shroud 38—as they extend in the upstream direction toward the wall 67 dividing the third and fourth passages and the fins 64 in the fifth passage 55 are angled so that they extend radially inward—that is, toward the inner shroud 36—as they extend in the upstream direction toward the wall 68 dividing the fourth and fifth passages.

Thus, the orientation of the fins 60–64—that is, the angle at which the fins extend as they extend along the length of the passage—is reversed with each succeeding passage.

Thus, the fins 61–64 not only increase the turbulence of the cooling air 80 but also serve to increase the flow rate of cooling air through the passages 51–55 by inhibiting flow separation.

Although the present invention has been discussed with reference to the third row of turbine vanes in a gas turbine, the invention is also applicable to other rows of vanes, as well as to other types of turbomachines in which airfoil cooling effectiveness is important. Accordingly, the present invention may be embodied in other specific forms without departing from the spirit or essential attributes thereof and, accordingly, reference should be made to the appended claims, rather than to the foregoing specification, as indicating the scope of the invention.

We claim:

1. A stationary vane for a turbine, comprising:

a) leading and trailing edges and first and second ends;

b) means for receiving a flow of cooling fluid;

c) a first passage disposed adjacent one of said edges, said first passage having means for directing said cooling fluid to flow in a direction from said second end toward said first end;

d) a plurality of first fins extending into said first passage, said first fins angled so as to extend toward said first end of said vane as they extend within said first passage toward said one of said edges to which said first passage is adjacent;

e) inner and outer shrouds; and f) a conduit extending through said inner shroud, said vane and said outer shroud.

2. The turbine vane according to claim 1, further comprising:

a) a second passage in sequential flow communication with said first passage, whereby said cooling fluid flows from said first passage to said second passage, said second passage having means for directing said cooling fluid to flow in a direction from said first end of said vane toward said second end;

b) a wall disposed between said first and second passages;

c) turning means for turning said flow of cooling fluid as it flows from said first passage to said second passage; and d) means for retarding flow separation in said cooling fluid as said cooling fluid is turned by said turning means.

3. The turbine vane according to claim 2, wherein said means for retarding flow separation comprises a plurality of second fins extending into said second passage, said second fins angled so as to extend toward said second end of said vane as they extend within said second passage toward said wall.

4. The turbine vane according to claim 3, wherein said turning means comprises a shroud formed on said first end of said vane and has means for turning said flow of said cooling fluid approximately 180°.

5. A stationary vane for a turbine, comprising:

a) leading and trailing edges and first and second ends;

b) first and second cooling fluid passages, said second passage being connected to said first passage so as to be in sequential flow communication therewith;

c) a plurality of first fins projecting into said first passage, said first fins angled so as to extend toward said first end of said vane as they extend toward said leading edge;

e) a plurality of second fins projecting into said second passage, said second fins angled so as to extend toward said second end of said vane as they extend toward said leading edge;

f) inner and outer shrouds; and g) a conduit extending through said inner and outer shrouds and extending through one of said cooling fluid passage.

6. The turbine vane according to claim 5, further comprising:

a) a third cooling fluid passage connected to said second passage so as to be in sequential flow communication therewith; and b) a plurality of third fins projecting into said third passage, said third fins angled so as to extend toward said first end of said vane as they extend toward said leading edge.

7. The turbine vane according to claim 5, wherein said first passage has means for directing cooling fluid from said second end of said vane toward said first end.

8. The turbine vane according to claim 5, wherein said first end of said vane is disposed radially inward from said second end, and wherein said first passage is disposed adjacent said leading edge.

9. A turbomachine comprising:

a) a compressor for producing compressed fluid;

b) a combustor for heating a first portion of said compressed fluid, thereby producing a hot compressed gas; and c) a turbine for expanding said hot compressed gas, said turbine having a stationary vane disposed therein for directing the flow of said hot compressed gas and a rotor, said vane having at least first and second cooling fluid passages formed therein, said first passage having means for receiving a second portion of said compressed fluid, said first and second passages being in sequential flow communication, whereby said second portion of said compressed fluid flows sequentially through said first passage and then through said second passage, said second passage having means for receiving a third portion of said compressed fluid from said compressor that bypasses said first passage, whereby said second and third portions of said compressed fluid combine in and flow through said second passage, said turbine further comprising a cavity formed between said vane and said rotor and said vane having inner and outer shrouds; and a conduit extending through said inner and outer shrouds and extending through one of said cooling fluid passages for directing a fourth portion of said compressed fluid to said cavity.

10. The turbomachine according to claim 9, wherein said turbine vane further comprises a third cooling fluid passage, said third passage being in sequential flow communication with said first and second passages, whereby said second portion of said compressed fluid flows sequentially from said third passage to said first passage to said second passage, said third portion of said compressed fluid bypassing both said first and third passages.

11. The turbomachine according to claim 10, wherein said turbine vane further comprises:

a) leading and trailing edge portions;

b) a fourth cooling fluid passage, said fourth passage in sequential flow communication with said second passage, whereby said second and third portions of said compressed fluid flow from said second passage to said fourth passage; and c) a plurality of fifth cooling fluid passages disposed in said trailing edge portion and in flow communication with said fourth passage, whereby said second and third portions of said compressed fluid flow from said fourth passage to said fifth passages.

12. The turbomachine according to claim 10, wherein said vane has an outer shroud formed thereon, said means for receiving said third portion of said compressed fluid comprising an opening formed in said outer shroud.

13. The turbomachine according to claim 9, wherein said conduit has an inlet, and wherein said turbine further comprises a manifold in flow communication with said means for receiving said third portion of said compressed fluid and in flow communication with said conduit inlet.

14. The turbomachine according to claim 9, wherein said conduit has an inlet for receiving said fourth portion of said compressed fluid.

15. The turbomachine according to claim 14, wherein said cavity is being formed between said vane inner shroud and said rotor, and wherein said conduit has an outlet in flow communication with said cavity, whereby said conduit directs said fourth portion of said compressed fluid through said inner and outer shrouds and through said one of said passages to said cavity.

16. The turbomachine according to claim 9, wherein said vane further comprises:

a) a third cooling fluid passage, said first passage being in sequential flow communication with said third passage, whereby said second portion of said compressed fluid flows sequentially from said third passage to said first passage to said second passage;

b) first and second walls enclosing said first and third passages;

c) a plurality of first fins extending from one of said walls into said third passage; and d) a plurality of second fins extending from one of said walls into said first passage.

17. The turbomachine according to claim 16, wherein said first and third passages extend radially through said vane, and wherein said first and second fins are angled with respect to the radial direction.

18. The turbomachine according to claim 17, wherein said first fins are angled so as to extend radially inward as they extend in the upstream direction with respect to the flow of said hot compressed gas through said turbine, and wherein said second fins are angled so as to extend radially inward as they extend in the downstream direction with respect to said flow of said hot compressed gas through said turbine.

19. The turbomachine according to claim 18, wherein said vane has leading and trailing edge portions, said third passage being formed in said leading edge portion.

* * * * *